US008167025B2

(12) United States Patent
Rombs et al.

(10) Patent No.: US 8,167,025 B2
(45) Date of Patent: May 1, 2012

(54) DUMMY BAR FOR A CONTINUOUS CASTING INSTALLATION AND METHOD OF USING THE SAME

(75) Inventors: Stefan Rombs, Düsseldorf (DE); Peter Jonen, Duisburg (DE)

(73) Assignee: SMS Siemag AG, Duesseldorf (DE)

( * ) Notice: Subject to any disclaimer, the term of this patent is extended or adjusted under 35 U.S.C. 154(b) by 0 days.

(21) Appl. No.: 12/736,366

(22) PCT Filed: Mar. 19, 2009

(86) PCT No.: PCT/EP2009/002035

§ 371 (c)(1),
(2), (4) Date: Dec. 7, 2010

(87) PCT Pub. No.: WO2009/121492

PCT Pub. Date: Oct. 8, 2009

(65) Prior Publication Data

US 2011/0094704 A1 Apr. 28, 2011

(30) Foreign Application Priority Data

Apr. 2, 2008 (DE) ..... 10 2008 016 759

(51) Int. Cl.
*B22D 11/08* (2006.01)

(52) U.S. Cl. ..... 164/483; 164/426; 164/446

(58) Field of Classification Search ..... 164/425, 164/426, 445, 446, 483
See application file for complete search history.

(56) References Cited

U.S. PATENT DOCUMENTS 3,581,808 A * 6/1971 Vertesi et al. ..... 164/445
3,717,198 A 2/1973 Marti et al.
4,074,745 A * 2/1978 Scheurecker et al. ..... 164/446
4,383,571 A 5/1983 Frantz
4,632,175 A 12/1986 McVay et al.

FOREIGN PATENT DOCUMENTS

DE 10 2006 023 503 2/2007
EP 0 043 365 3/1984

* cited by examiner

*Primary Examiner* — Kuang Lin
(74) *Attorney, Agent, or Firm* — Abelman, Frayne & Schwab

(57) ABSTRACT

The invention relates to a dummy bar (1) for a continuous casting installation for casting a metal strand, including a dummy bar head (2), a transition piece (3) and a link chain (4), wherein the transition piece (3) and/or the link chain (4) are made of a plurality of links (5, 6) that are connected to each other in an articulated manner, and wherein the links (5, 6) can be pivoted relative to each other about a transverse axis (Q) extending perpendicular to the longitudinal axis (L) of the dummy bar (1). In order to particularly prevent internal stresses in the dummy bar when replacing parts of the dummy bar, the invention provides for at least one articulated joint (7) to be configured between two links (5, 6) that are connected to each other in an articulated manner, such that said joint allows a relative pivoting movement of the links (5, 6) about the transverse axis (Q) that is greater than any pivot angle ($\alpha$) occurring during the use of the dummy bar (1). In or on the joint (7), a locking element (8) is displaceably arranged in a direction (T) perpendicular to the longitudinal axis (L) of the dummy bar (1) and perpendicular to the transverse axis (Q). The locking element (8) can assume a position (A) in which the pivoting movement of the links (5, 6) is not influenced by the locking element (8), and a position (B) in which the pivoting movement of the links (5, 6) is limited to a predetermined pivot angle in a pivoting direction. The invention further relates to a method of the continuous casting of a metal billet using such a dummy bar.

5 Claims, 3 Drawing Sheets

DUMMY BAR FOR A CONTINUOUS CASTING INSTALLATION AND METHOD OF USING THE SAME

BACKGROUND OF THE INVENTION

1. Field of the Invention

The invention relates to a dummy bar for a continuous casting installation for casting a metal strand and having a dummy bar head, a transition piece, and a link chain, wherein the transition piece is arranged between the dummy bar head and the link chain, wherein the transition piece and/or the link chain are formed of a plurality of links connected with each other in an articulated manner, and wherein the links are pivotable relative to each other about a transverse axis extending perpendicular to a longitudinal axis of the dummy bar. The invention further relates to a method of continuous casting a metal strand with which such a dummy bar is used.

2. Description of the Prior Art

A dummy bar of the type described above is used for starting a continuous casting process in a continuous casting installation. The mold of the continuous casting installation is closed at its outlet with the dummy bar head in order to be able to introduce melt into the mold in a first complete process; the dummy bar head prevents an immediate exit of the melt from the mold. After a first solidification, the formed strand is withdrawn from the mold, together with the dummy bar, and is transported over the strand guide of the continuous casting installation and a horizontal roller table. Subsequently, the dummy bar is again transported to the mold to be available for the next starting process. At so-called "top feeding," the dummy bar is displaced in a loop through the continuous casting installation, i.e., behind a horizontal roller table, it is displaced upwardly to a level of the casting platform and is pulled onto a dummy bar rack and is transported again in direction of the mold.

Dummy bars of the above-described type are disclosed, e.g., in DE 2 103 417 A1, in EP 0 043 365 B1, in U.S. Pat. No. 4,632,175, and in DE 10 2006 023 503 B3.

Because the dummy bar head, as a rule, has a greater thickness than the following link chain, when the dummy bar rests flatly, e.g., on the dummy bar rack, from time to time, increased stresses are generated in the articulated joints; the link-shaped dummy bar buckles up. Therefore, the links or the articulated joints are subjected to an increased load which causes wear, in particular, when the dummy bar head together with the transition links lies on the dummy bar rack. This is particularly the case when at a relative pivotal movement, the articulated joints do not allow any evasion of the colliding chain links. In the stand-by and exchange position, the handling of the dummy bar is problematic, in particular when sections of the dummy bar need be replaced.

To this end, it is mostly necessary to lift the dummy bar with a crane in order to reduce the stresses in the articulated joints.

SUMMARY OF THE INVENTION

The object of the present invention is to modify a dummy bar of the above-mentioned type so that without special means, it would be possible to prevent stresses in the articulated joints of the dummy bar when it rests flatly, in particular, on a dummy bar rack. Further, a method of its use is suggested.

The solution for achieving this object is characterized, according to the invention, in that at least one articulated joint between two links connected with each other in articulated manner is so formed that it provides for a relative movement of the links about the transverse axis which is greater than any pivot angle encountered during the use of the dummy bar, wherein a locking element, which is displaceable in a direction perpendicular to the longitudinal axis of the dummy bar and perpendicular to the transverse axis, is arranged in or on the articulated joint, and wherein the locking element can occupy a position in which a pivotal movement of the links is not influenced by the locking element, and can occupy a position in which the pivotal movement of the links in a pivotal direction is limited to a predetermined pivot angle.

The locking element is advantageously displaceably arranged in a linear guide.

Advantageously, the locking element assumes its position exclusively under action of the gravity force.

The articulated joint provided with a locking element can be arranged only in the transition piece of the dummy bar.

Mostly, a thickness of the dummy bar head is greater than a thickness of the link chain.

The method of continuous casting a metal strand in which a dummy bar of the described type is used, contemplates that, firstly, the dummy bar is introduced in a mold from above, then that the dummy bar is displaced from the mold downwardly along a strand guide, that the dummy bar is transported behind the strand guide on a horizontal roller table, that the dummy bar is pulled from the roller table with the dummy bar head being automatically disconnected from the hot strand that the dummy bar is displaced only horizontally in direction of the mold and, finally, the dummy bar is again introduced from above into the mold for a next cast. Thus, "top feeding" is provided. According to the invention, the method is characterized in that the locking element occupies, during introduction in the mold, the position in which the locking element does not influence the pivotal movement of the links.

It is further provided that the locking element is displaced, during movement of the dummy bar downwardly along the strand guide, from the position in which the locking element does not influence the pivotal movement of the links into the position in which the pivotal movement of the links is limited to a predetermined angle.

It further can be provided that the locking element occupies, during displacement of the dummy bar on the horizontal roller table, the position in which the pivotal movement of the links is limited to a predetermined angle.

Further, the locking element can displace, during the movement of the dummy bar upwardly onto the dummy bar rack, from the position in which the pivotal movement of the links is limited to a predetermined angle, into position in which the locking element does not influence the pivotal movement of links.

Finally, it can be provided that the locking element occupies, during the horizontal movement of the dummy bar on the casting platform toward the mold, the position in which the locking element does not influence the pivotal movement of the links.

The displacement of the locking element between its positions takes place here advantageously exclusively under the action of the gravity force of the locking element.

With the chain links being supported, in the horizontal position of the roller table, beneath each other, the vertically movable support disc displaces, as a result of the gravity force, in a corresponding slot, in accordance with the use status of the dummy bar, i.e., dependent on the actual location and the position of the dummy bar. The support disc, which functions as a locking element, either allows deviations of two adjacent chain links or prevents those, dependent on the position of the locking element in the articulated joint.

The proposed solution enables operation of the dummy bar with a very small wear and permits to achieve improved exchange conditions, independent of thickness ratios (ratio of the thickness of the dummy bar head to the thickness of the chain link). The dummy bar, as a result, does not form, even when laying flatly, any "hunchback" that, with existing solutions, leads to high stresses in the articulated joints.

The proposed method of use of such a dummy bar provides for "top feeding" and, thereby, for circulation of the dummy bar during its use, i.e., its use in a circulating system.

Thereby, the load of the chain links is substantially reduced, which also correspondingly reduces wear.

At the location of the locking members, transition pieces and the dummy bar head can be replaced, i.e., both functions are available at the separation point.

BRIEF DESCRIPTION OF THE DRAWINGS

The drawings show an embodiment of the invention. In the drawings.

DETAILED DESCRIPTION OF THE PREFERRED EMBODIMENTS

Figure 1:
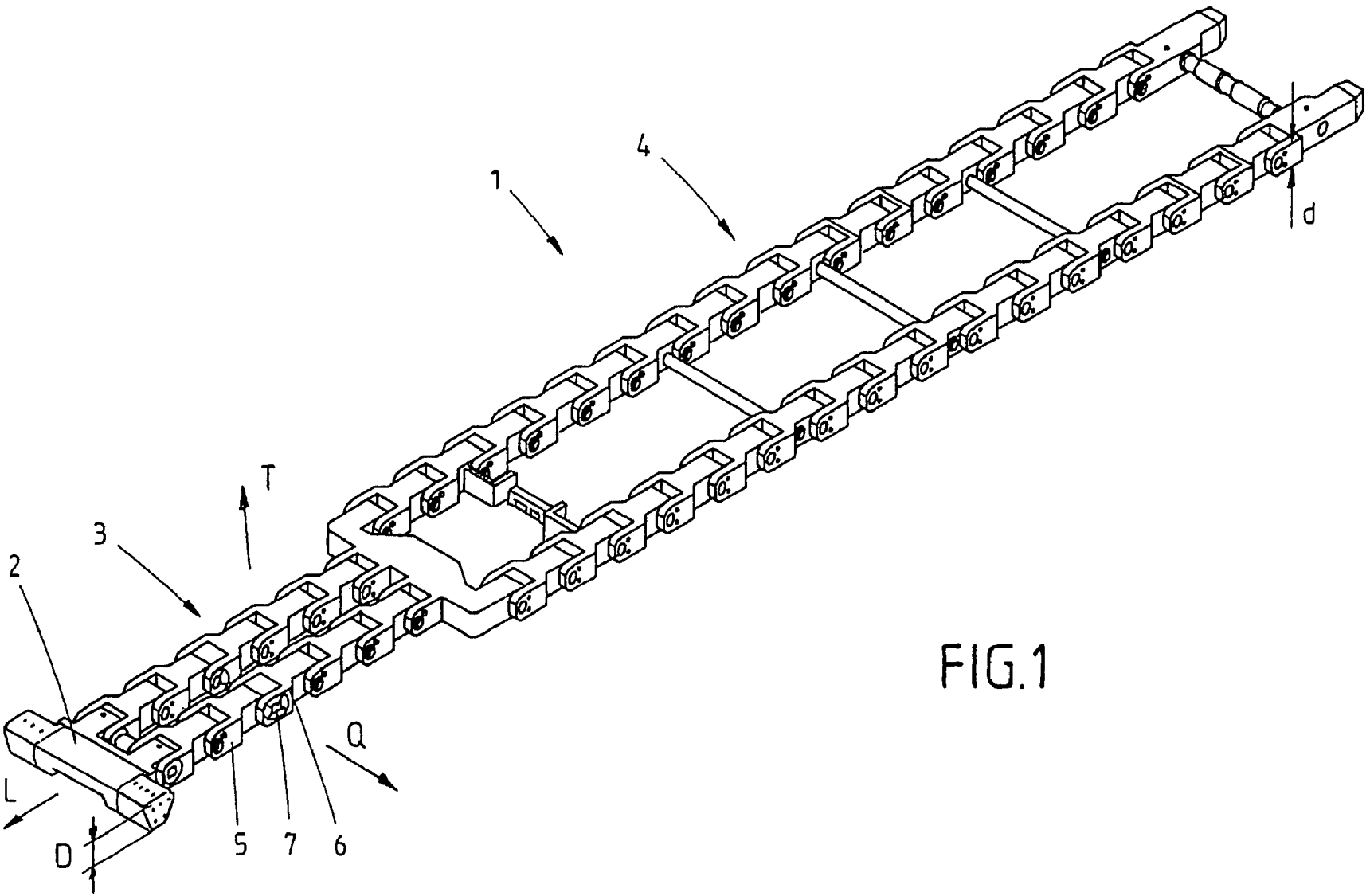
FIG. 1 shows a perspective view of a dummy bar for continuous casting.

FIG. 1 shows a dummy bar 1 to be used in a continuous casting installation. The dummy bar has a longitudinal axis L and a dummy bar head 2 the geometry of which is adapted to dimensions of a mold. Behind the dummy bar head 2, there is arranged a transition piece 3 in form of separate links 5, 6 connected with each other in an articulated manner and which is adjoined with a link chain 4. In this regard, the dummy bar 1 is known, reference being made to documents mentioned above.

The dummy bar head 2 has a thickness D that is greater than a thickness d of the link chain 4.

As it is shown for the region of the transition piece 3, an articulated joint 7 supports two adjacent links 5, 6 for pivotal movement relative to each other about a transverse axis Q (pivot angle α, see FIG. 3); the transverse axis Q extends perpendicular to the longitudinal axis L.

Of importance is, being taken into consideration later, axis T for a translational displacement and which extends perpendicular to both the longitudinal axis L and the transverse axis Q.

Figure 2:
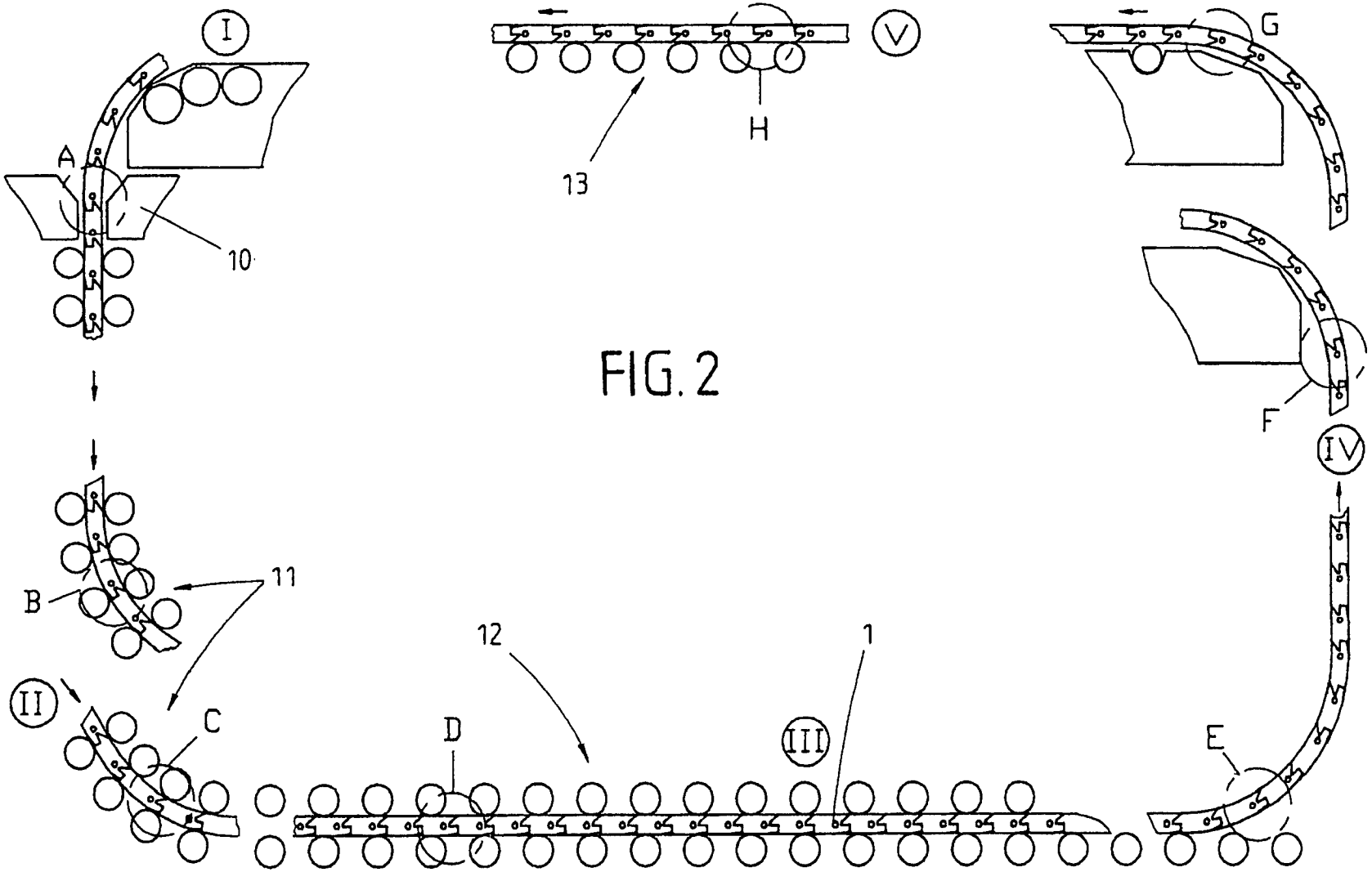
FIG. 2 shows schematically circulation of a dummy bar in a continuous casting installation of which sections are shown.
Figure 3G:
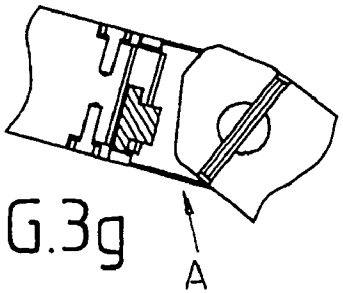
FIG. 3 shows schematically two adjacent links of the dummy bar which are provided with a locking element in the articulation joint.
Figure 3F:
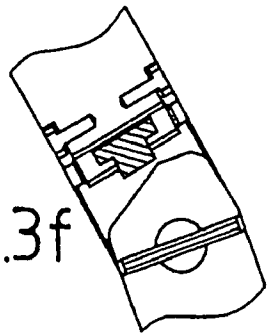
Figure 3E:
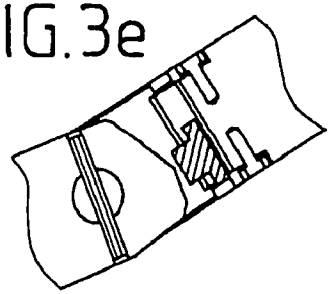
Figure 3H:
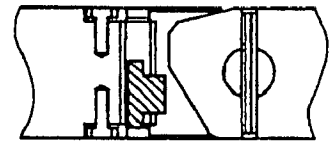
Figure 3D:
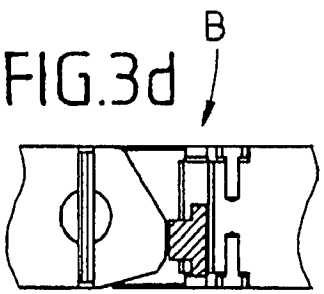
Figure 3A:
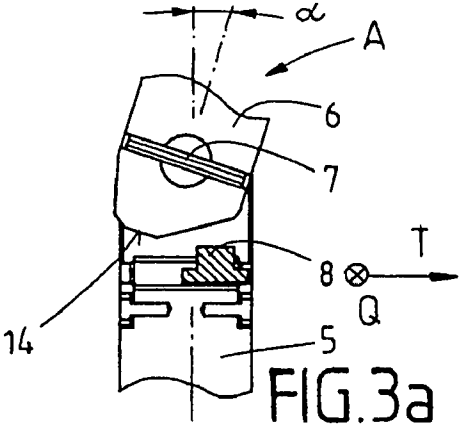
Figure 3B:
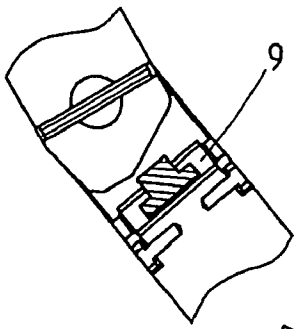
Figure 3C:
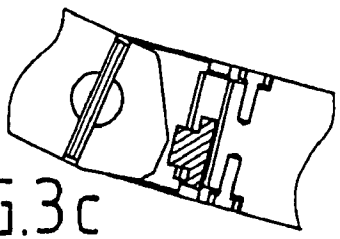

In FIG. 2, the circulation of the dummy bar 1 through the continuous casting installation is shown, with separate stations being indicated only schematically.

At a first side I, the dummy bar 1 is inserted in a mold 10.

At a second site II, behind the mold 10, the dummy bar 10 is displaced along a strand guide 11.

At a third side III, the dummy bar 1 is displaced in the strand guide and horizontally on a roller table 12, resting thereon.

At a fourth site IV, the dummy bar 1 is lifted, with a lever, not shown, upward to a level of a casting platform and is pulled onto a dummy bar rack 13.

At a site V, the dummy bar 1, which is located on the dummy bar rack 13, is finally displaced again in direction of the mold 10 to be available for next insertion. On the dummy bar rack 13, at the site V, if needed, exchange of portions of the dummy bar 1 can be carried out to adapt it, e.g., to another geometry of a mold.

In FIGS. 3*a* through 3*h*, which corresponds to respective marked points along the circulation path of the dummy bar 1, there are shown two links 5 and 6 which include an articulated joint 7 that provides, when needed, for relative movement of the links 5 and 6 about a pivot angle α (see FIG. 3*a*), while preventing the same under certain conditions. The allowable pivot angle α of the articulated joint 7 is greater than that necessary in all operational situations of the dummy bar 1, i.e., the pivotability of the links 5, 6 is generally not limited.

FIGS. 3*a* through 3*h* show enlarged sections of the links 5, 6, together with the articulated joint 7, corresponding to the sites I-V according to FIG. 2 in accordance with the path the dummy bar 1 covers during its circulation.

To this end, the link 5 has a linear guide 9 extending in direction T, i.e., perpendicular to the transverse axis Q and to the longitudinal axis L. In the linear guide, a locking element 8 is located.

The locking element 8 is movable between two positions A and B:

In the position A (see, e.g., FIG. 3*a*), the locking element 8 is so displaced that the stop edge 14 on the link 6 cannot contact it. A pivotal movement of both links 5, 6 about a pivot angle α is possible up to the maximum arbitrary pivot angle.

In another position B (see, e.g., FIG. 3*d*), the locking element 8 is located in another end region of the linear guide 9, so that now, in case the links 5, 6 would like to pivot relative to each other, the stop edge 14 bumps into the locking element 8 and, thus, the pivotal movement is prevented.

The locking element 8 is displaceable under its own weight in a respective end region of the linear guide 9, i.e., in a locking or release position A, B.

As can be seen in FIGS. 3*a* through 3*h*, during the circulation of the dummy bar 1 from the mold 10 over the strand guide 11 and the roller table 12 and over the dummy bar rack 13 back to the mold 10, respective locking and release positions for links 5, 6 are produced. In particular, on the roller table 12, the links 5, 6 are locked, whereas on the dummy bar rack 13, they are released. Thus, in accordance with the job, when the dummy bar 1 rests flatly on the dummy bar racks 13, no tension can occur in the articulated joints as a results of arching of the dummy bar.

List of Reference Numerals

1 Dummy bar
2 Dummy bar head
3 Transition piece
4 Link chain (=basic dummy bar, has constant thickness)
5 Link
6 Link
7 Articulated joint
8 Locking element
9 Linear guide
12 Roller table
13 Dummy bar rack
14 Stop edge
L Longitudinal axis
Q Transverse axis
T Translational axis
A Release position
B Locking position
α Pivot angle
D Thickness of the dummy bar head
d Thickness of the link chain I Insertion of the dummy bar into a mold
II Displacement of the dummy bar along a strand guide
III Displacement of the dummy bar on the roll table
IV Pulling of the dummy bar onto a dummy bar rack
V Displacement of the dummy bar toward the mold.

The invention claimed is:

1. A dummy bar (1) for a continuous casting installation for casting a metal strand, comprising a dummy bar head (2), a transition piece (3), and a link chain (4), wherein the transition piece (3) is arranged between the dummy bar head (2) and the link chain (4), wherein at least one of the transition piece (3) and the link chain (4) are formed of a plurality of links (5, 6) connected with each other in an articulated manner, and wherein the links (5, 6) are pivotable relative to each other about a transverse axis (Q) extending perpendicular to a longitudinal axis (L) of the dummy bar (1), characterized in that at least one articulated joint (7) between two links (5, 6) connected with each other in articulated manner is so formed that it provides for a relative movement of the links (5, 6) about the transverse axis (Q) which is greater than any pivot angle (a) encountered during use of the dummy bar (1), wherein a locking element (8), which is displaceable in a direction (T) perpendicular to the longitudinal axis (L) of the dummy bar (1) and perpendicular to the transverse axis (Q), is arranged in one of the links (5,6), wherein the locking element (8) is displaceable between a first position (A) in which a pivotal movement of the links (5, 6) is not influenced by the locking element (8), and a second position (B) in which the pivotal movement of the links (5, 6) in a pivotal direction is limited to a predetermined pivot angle, and wherein the locking element (8) displacing between its positions (A, B) only due to action of the gravity force.

2. A dummy bar according to claim 1, characterized in that the locking element (8) is displaceably arranged in a linear guide (9).

3. A dummy bar according to claim 1, characterized in that the link (5) provided with a locking element (8) is arranged only in the transition piece (3) of the dummy bar (1).

4. A dummy bar according to claim 1, characterized in that a thickness (D) of the dummy bar head (2) is greater than a thickness (d) of the link chain (4).

5. A method of using a dummy bar in a continuous casting installation for casting a metal strand, the dummy bar (1) having a dummy bar head (2), a link chain (4), and a transition piece (3) arranged between the dummy bar head (2) and the link chain (4), at least one of the transition piece (3) and the link chain (4) being formed of a plurality of links (5, 6) connected with each other in an articulated manner and pivotable relative to each other by an angle greater than any pivot angle ($\alpha$) encountered during use of the dummy bar (1), at least one of the links (5, 6) being provided with a locking element (8), which is displaceable in a direction (T) perpendicular to the longitudinal axis (L) of the dummy bar (1) between a first position (A) in which a pivotal movement of the links (5, 6) is not influenced by the locking element (8), and a second position (B) in which the pivoted movement of the links (5, 6) in a pivotal direction is limited to a predetermined pivot angle (a), the method comprising the steps of:

Introducing the dummy bar (1) in a mold (10) from above (I), with the locking element (8) located in the first position (A);

displacing the dummy bar (1) from the mold (10) downwardly along a strand guide (11), with the locking element (8) displacing from the first position (A) into the second position (B), transporting the dummy bar (1) behind the strand guide (11) on a horizontal roller table (12),with the locking element (8) located in the position (B);

pulling the dummy bar (1) from the roller table (12), after having the dummy bar (1) disconnected from a hot strand, upwardly onto a dummy bar rack (13) located on a casting platform (IV), with the locking element (8) displacing from the second position (B) into the first position (A);

displacing the dummy bar (1) only horizontally in direction of the mold (10), with the locking element (8) located in the first position (A); and introducing the dummy bar (1) again into the mold (10) from above for a next cast;

wherein the movements of the locking element (8) between the first and second positions (A, B) takes place exclusively due to action of the gravity force of the locking element (8).

* * * * *